United States Patent [19]

Lara et al.

[11] 4,023,058

[45] May 10, 1977

[54] SPARK PLUG

[76] Inventors: Jose Hector Lara; Edward B. Williams, Jr., both of P.O. Box 876, Greenville, Tex. 75401

[22] Filed: May 14, 1976

[21] Appl. No.: 686,559

[52] U.S. Cl. ..... 313/139; 313/141; 313/142; 313/11.5

[51] Int. Cl.² ..... H01T 13/20

[58] Field of Search ..... 313/139, 141, 142, 11.5

[56] References Cited

UNITED STATES PATENTS

| | | | |
|---|---|---|---|
| 1,226,399 | 5/1917 | Smith | 313/142 X |
| 1,352,775 | 9/1920 | Bell | 313/142 X |
| 1,479,643 | 1/1924 | Blomster | 313/141 |
| 2,944,178 | 7/1960 | Schaub | 313/141 |

*Primary Examiner*—Rudolph V. Rolinec

*Assistant Examiner*—Darwin R. Hostetter

*Attorney, Agent, or Firm*—Fishburn, Gold & Litman

[57] ABSTRACT

An improved spark plug for use in internal combustion engines includes a center or first electrode positioned within a spark plug insulator member in a metal shell. An outer or second electrode extends from the metal shell and has a free end portion thereof spaced from a free end portion of the center electrode. An annular spark discharging surface is formed on said free end portion of the center electrode and an annular spark landing surface is formed on said free end portion of the outer electrode with the discharging and landing surfaces being in opposed or facing relation and cooperating to provide a spark in the form of a hollow column. A port is provided in the second electrode and is surrounded by the spark landing surface so that fuel on the opposite side of the outer electrode will be ignited.

8 Claims, 6 Drawing Figures

SPARK PLUG

The present invention relates to spark plugs and more particularly to a spark plug having facing first and second spaced electrode portions with an annular spark discharging surface and an annular spark landing surface respectively in facing and opposed relation to provide a spark in the form of a hollow column. A port is provided in the outer or second electrode and is surrounded by the spark landing surface so that fuel on the opposite side of the second electrode will be ignited.

It has been found that increasing the surface area of a spark substantially improves the starting area of ignition, therefore, combustion ignited by a spark of a larger size is completed faster than normal combustion ignited by a smaller diameter or area of spark. It has also been found that by forming the geometry of the spark discharging surface, as a closed geometric figure and also by forming the geometry of the spark landing surface as a closed geometric figure that the discharge spark is forced to be of a larger size. It has also been found that the horse power of the internal combustion engine is substantially improved in the beginning portion of combustion when the time required to complete combustion is reduced. Even a minor improvement in the reduction of combustion time results in a substantial improvement in the economy and performance of an internal combustion engine. It has also been found that providing a port through the second or outer electrode which is surrounded by the spark landing surface permits ignition of fuel on the opposite side of the outer electrode for even faster combustion.

The principal objects of the present invention are: to provide an improved spark plug operative to effect improved performance and economy of operation of internal combustion engines; to provide such a spark plug operative to focus an enlarged and thereby hotter spark between the spaced electrodes; to provide such a spark plug operative to effect improved and more complete burning or combustion of fuel in a combustion chamber; to provide such a spark plug with an annular spark discharging surface in facing and opposed relation with an annular spark landing surface; to provide such a spark plug operative to provide a spark in the form of a hollow column and an enlarged surface area; to provide such a spark plug wherein operation thereof is substantially free from lead and ash buildup on the electrodes thereof; to provide such a spark plug operative to form a spark in the form of a hollow column with an enlarged base igniting fuel both inside and outside said column rather than only on the outside as with the rod-like spark as in conventional spark plugs thereby providing substantially greater surface area of the spark and more uniform and faster burning of the fuel than fuel ignited by a spark of a conventional spark plug; to provide such a spark plug wherein the spark discharging surface and the spark landing surface are in opposed relation and with the port through the spark landing surface having a diameter equal to or larger than the spark discharging surface; to provide a spark plug operative to effect ignition of fuel on the opposite side of a second or outer electrode for even faster combustion; to provide such a spark plug capable of operating at increased temperature thereby substantially reducing buildup of deposit on each electrode; and to provide such a spark plug which is economical to manufacture, is durable in construction, has longer useful life than conventional spark plugs, is positive in operation, and is particularly well adapted for the proposed use.

Other objects and advantages of this invention will become apparent from the following description taken in connection with the accompanying drawings wherein are set forth by way of illustration and example certain embodiments of this invention.

The drawings constitute a part of the specification and include exemplary embodiments of the present invention and illustrate various objects and features of the improved spark plug.

Figure 1:
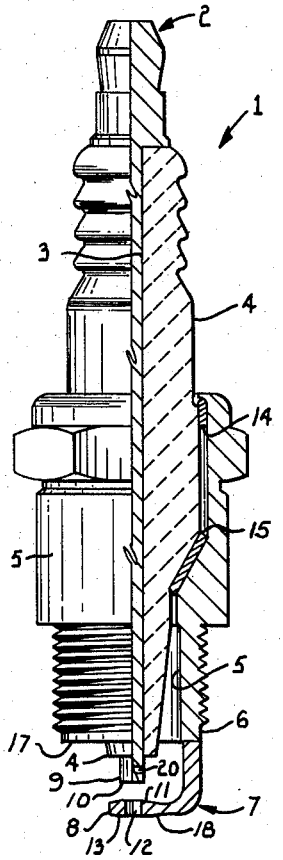
FIG. 1 is a side elevational view of a spark plug embodying features of the present invention and with portions broken away to better illustrate component parts of the spark plug.

As required, detailed embodiments of the present invention are disclosed herein, however, it is to be understood that the disclosed embodiments are merely exemplary of the invention which may be embodied in various forms. Therefore, the specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally an improved spark plug for use in an internal combustion engine (not shown). The improved spark plug 1 includes an elongated center or first electrode 2 extending through a center bore 3 in an insulator member 4 mounted in a central passage 5 through a metal shell 6. An outer or second electrode 7 extends from the metal shell 6 and has a one or free end portion 8 thereof spaced from one end portion 9 of the center of first electrode 2. A spark discharging portion or surface 10 is formed on the one end portion 9 of the center electrode 2 and a spark landing portion or surface 11 is formed on the one or free end portion 8 of the outer electrode 7 with the discharging and landing surfaces 10 and 11 being in opposed or facing relation. A port 12 is formed in the second or outer electrode 7 and is surrounded by the spark landing surface 11 so that fuel on the opposite side 13 of the outer electrode 7 will be ignited substantially simultaneously with ignition of fuel by the spark between the electrodes 2 and 7.

The spark discharging portion 10 and the spark landing portion 11 are formed by ridges on the first and second electrodes 2 and 7 respectively and the ridges are in the form of a closed geometric figure. The ridges cooperate to provide a spark in the form of a hollow column in the shape of the geometric figures. When the geometric figures are each circles the spark discharging portion 10 and the spark landing portion 11 are annular and the spark is in the form of a hollow column. It is preferred that the hollow column have a larger end at the spark landing surface 11 than at the spark discharging surface 10 thereby providing an enlarged surface area of the spark.

Figure 2:
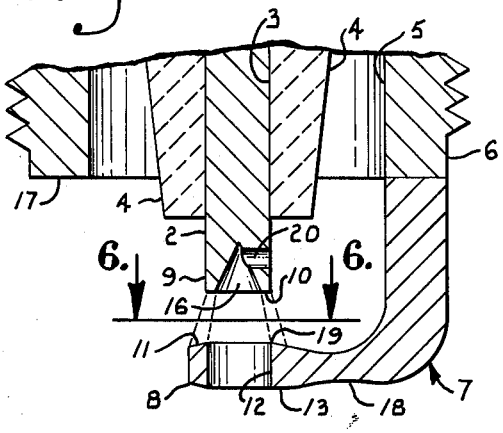
FIG. 2 is an enlarged fragmentary sectional view showing end portions of facing electrodes.

In the illustrated structure, the insulator member 4 is sealed within the metal shell 6 in a conventional manner, such as by using upper and lower metal ring seals 14 and 15 respectively positioned on respective shoulders of the insulator member 4. The center electrode 2 has an upper end portion thereof adapted to receive a suitable spark plug wire (not shown) in any conventional manner. The present invention, as illustrated, includes forming the center electrode 2 as an elongated cylindrical rod having a longitudinal axis extending between opposite ends thereof and forming the lower or one end portion 9 of the center of first electrode 2 with a recess 16 therein, illustrated as conical, and surrounded by the annular spark discharging surface 10. As best shown in FIGS. 1 and 2, the one end portion 9 of the center electrode 2 is spaced from the lower end of the insulator member 4.

The present invention, as illustrated, also includes forming the outer electrode 7 as a generally planar member with the one or free end portion 8 thereof as an annular portion defining the spark landing surface 11. The free end of the outer electrode 7 has the port 12 therein which is illustrated as cylindrical and surrounded by the annular spark landing surface 11. The spacing between the spark discharging surface 10 and the spark landing surface 11 is determined by the operative characteristics of the respective internal combustion engine.

As illustrated in FIGS. 1 and 2, the outer electrode 7 extends in an arcuate path from the lower end 17 of the metal shell 6 and has the free end portion 8 thereof in opposed and facing relation with the free or lower end portion 9 of the center electrode 2.

Figure 6:
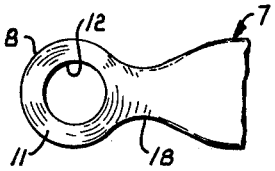
FIG. 6 is a further enlarged fragmentary view taken on line 6—6 of FIG. 2 and showing a spark landing surface of an outer electrode.

In the illustrated structure, the outer or second electrode 7 has a reduced thickness portion 18 adjacent the spark landing surface 11. The planar member or bar defining the outer electrode 7 is reduced in both thickness and width, as best seen in FIGS. 2 and 6, so that the portion defining the port 12 and the spark landing surface 11 is substantially larger in both width and thickness than the reduced thickness portion 18.

The port 12 through the one end portion 8 of the second or outer electrode 7 is defined by a surface having one edge 19 forming an upper limit for and a common edge with the ridge defining the annular spark landing surface 11 on the second electrode one end portion 8.

The spark landing surface 11 on the second electrode one end portion 8 is defined by a surface extending from and inclined from the one or common edge 19 of the surface defining the port 12 through the second electrode one end portion 8 so that the common edge 19 forming the upper limit of the ridge or spark landing surface 11 is closest to the ridge or spark discharging surface 10 on the first electrode one end portion 9. The slope or incline of the spark landing surface 11 is in the nature of 10° from a plane through the common edge 19 of the port 12 and the spark landing surface 11 and parallel with the surface defining the spark discharging surface 10.

The illustrated port 12 has a diameter equal to or larger than the diameter of the surface defining the recess 16 in the one end portion 9 of the center electrode 2. In the illustrated embodiment, the diameter of the port 12 is approximately equal to the diameter of the center electrode 2 so that the spark is larger at the spark landing surface 11 than at the spark discharging surface 10 thereby providing an increased surface area of the spark.

The fuel surrounded or enclosed within the hollow column of the spark is ignited by the spark and flows outwardly through the port 12 and thereby ignites fuel adjacent the opposite 13 of the outer electrode 7 substantially simultaneously with ignition of fuel between the electrodes 2 and 7 by the spark therebetween.

It is also desirable to allow flow of a portion of the fuel adjacent the center electrode 2 outward from the interior of the hollow column of spark to ignite fuel adjacent the exposed portion of the center electrode 2, therefore, the one end portion 9 of the center electrode 2 has a port 20 extending between the recess 16 and the exterior surface of the outer electrode 2.

The reduced thickness portion 18 of the outer electrode 7 and the incline or slope of the spark landing surface 11 cooperate to increase the temperature of the portion of the outer electrode 7 defining the spark landing surface 11 and the port 12 therethrough so that lead and other materials remain molten and do not form deposits on the outer electrode 7.

Figure 3:
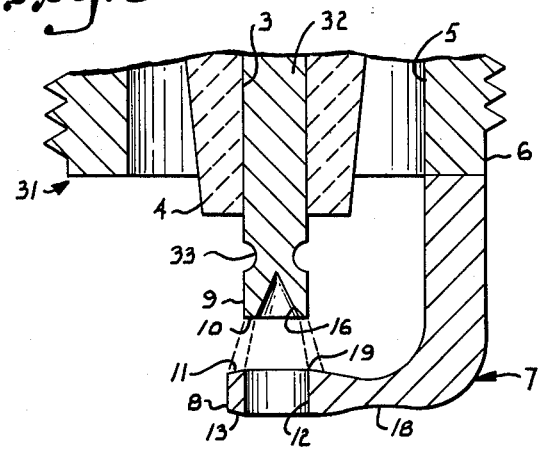
FIG. 3 is an enlarged fragmentary sectional view showing end portions of a first modified spark plug.

FIG. 3 illustrates a spark plug 31 including a modified center electrode 32 extending through the center bore 3 of the insulator member 4. The spark plug 31 includes an outer or second electrode 7 extending from the metal shell 6 and the outer electrode 7 is substantially similar to the outer or second electrode 7 illustrated in FIGS. 1 and 2. The spark plug 31 includes the spark discharging surface 10 formed on the one end portion 9 of the center electrode 32 and the spark landing surface 11 on the one end portion 8 of the outer electrode 7. The spark discharging and landing surfaces 10 and 11 are each similar to respective spark discharging and spark landing surfaces 10 and 11 illustrated in FIGS. 1 and 2.

The modified center electrode 32 includes a reduced thickness portion 33 positioned between the spark discharging surface 10 and the adjacent end of the insulator member 4. The reduced thickness portion 33 cooperates with a recess 16 in the end of the modified center electrode 32 to increase the temperature of the portion of the modified center electrode 32 defining the spark discharging surface 10 so that lead and other materials remain molten and do not form deposits on the modified center electrode 32 and particularly on the surface defining the recess 16 and the spark discharging surface 10 of the modified center electrode 32.

Figure 4:
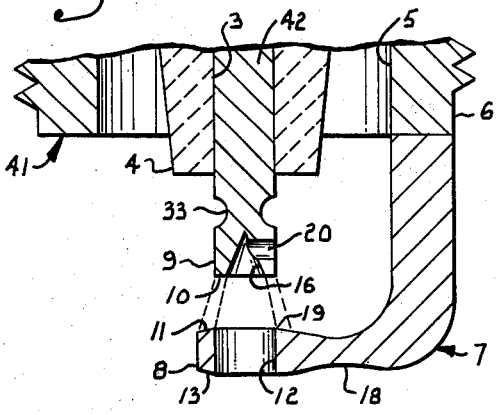
FIG. 4 is an enlarged fragmentary sectional view showing end portions of a second modified spark plug.

FIG. 4 illustrates a spark plug 41 which includes a modified center electrode 42 extending through the center bore 3 of the insulator member 4. The spark plug 41 includes an outer or second electrode 7 extending from the metal shell 6 and the outer electrode 7 is substantially similar to the outer electrode 7 illustrated in FIGS. 1-3 inclusive. The spark plug 41 includes the spark discharging surface 10 formed on the one end portion 9 of the center electrode 42 and the spark landing surface 11 formed on the one end portion 8 of the outer electrode 7. The spark discharging and landing surfaces 10 and 11 are each similar to respective spark discharging and spark landing surfaces 10 and 11 illustrated in FIGS. 1–3 inclusive.

The modified center electrode 42 includes both the reduced thickness portion 33 illustrated in FIG. 3 and the port 20 extending between the recess 16 and the exterior surface of the modified center electrode 42. The combination of the reduced thickness portion 33 and the port 20 cooperate to allow escape of ignited fuel from within the hollow column of the spark between the electrodes 42 and 7 and to increase the temperature of the modified center electrode 42 extending beyond the one end of the insulator member 4 so that lead and other materials remain molten and do not form deposits on the modified center electrode 42 particularly on the surface defining the recess 16, port 20, and spark discharging surface 10 of the modified center electrode 42.

Figure 5:
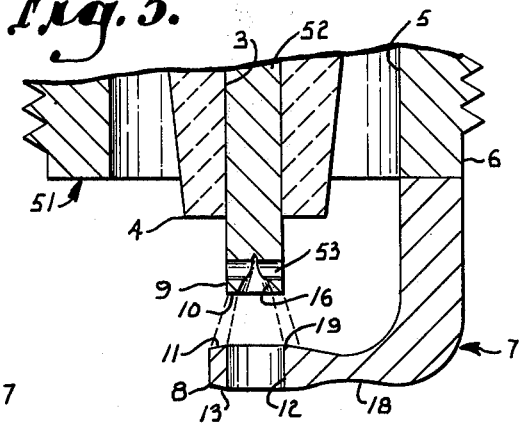
FIG. 5 is an enlarged fragmentary sectional view showing end portions of a third modified spark plug.

FIG. 5 illustrates a spark plug 51 including a modified center electrode 52 extending through the center bore 3 of the insulator member 4. The spark plug 51 includes an outer or second electrode 7 extending from the metal shield 6 and the outer electrode 7 is substantially similar to the outer or second electrode 7 illustrated in FIGS. 1–4 inclusive. The spark plug 51 includes the spark discharging surface 10 formed on the one end portion 9 of the center electrode 52 and the spark landing surface 11 formed on the one end portion 8 of the outer electrode 7. The spark discharging and landing surfaces 10 and 11 are each similar to the respective spark discharging and landing surfaces 10 and 11 illustrated in FIGS. 1–4 inclusive.

The modified center electrode 52 has the recess 16 in the one end portion 9 and the recess 16 is substantially similar to the recess 16 illustrated in FIGS. 1–4 inclusive. The modified center electrode 52 includes a bore 53 extending transversely through the one end portion 9 of the modified center electrode 52 and the bore 53 intersects the longitudinal axis of the modified center electrode 52. The bore 53 also intersects and communicates with the recess 16 in the one end portion 9 of the modified center electrode 52.

The bore 53 performs the same function as the port 20 illustrated in FIGS. 1 and 3 and permits escape of ignited fuel from within the hollow column of spark between the spark discharging surface 10 and the spark landing surface 11 in a manner similar to escape of ignited fuel through the port 20 illustrated in FIGS. 1, 2, and 4. Forming the bore 53 in the one end portion 9 of the modified center electrode 52 also substantially reduces the material of the one end portion 9 so that the spark heats the center electrode 52 so that lead and other materials remain molten and do not form deposits on the modified center electrode 52 and particularly on surfaces defining the recess 16, the spark discharging surface 10, and the bore 53.

Use of the spark plug illustrated in FIGS. 1–6 inclusive is substantially similar to use of conventional spark plugs, however, it has been found that forming the spark with a substantially increased surface area that the commencing of combustion is more effective than combustion ignited by conventional spark plugs and, therefore, combustion is completed substantially faster than using conventional spark plugs. It has been found that forming the port 12 through the one end portion 8 of the outer electrode 7 and forming the port 20 or the bore 53 permits escape of ignited fuel from within the hollow column of spark and effects ignition of fuel both on the opposite side 13 of the outer electrode 7 and adjacent the respective center electrode. It has also been found that the initial combustion is extremely critical in smoothness of operation, timing of respective power strokes, and actual power effected by combustion. Increasing the size of the spark has substantially reduced the burning or combustion time of the fuel and at no increase in the electrical power employed to create the spark. It has also been found that forming reduced thickness portions in the center electrode and the outer electrode that those parts have an increased temperature so that lead and other deposit forming materials remain molten and flow away from the respective electrodes. It has also been found that sloping the spark landing surface 11 causes the column of spark between the electrodes to be larger adjacent the spark landing surface and deposit forming materials flow outwardly from the common edge 19 of the surface defining the port 12 and the respective spark landing surface 11.

It is to be understood that while we have illustrated and described certain forms of our invention, it is not to be limited to these specific forms or arrangement of parts herein described and shown.

What we claim and desire to secure by Letters Patent is:

1. In a spark plug having a metal shell with an insulator positioned therein and a first electrode extending from one end of said insulator and a second electrode extending from said metal shell, said first and second electrodes having free end portions in adjacent spaced relation, a spark controlling structure comprising:

a. means on free end portions of first and second electrodes defining respective facing ridges each in the form of a closed geometric figure thereby defining a spark discharging portion on said first electrode and a spark landing portion on said second electrode whereby said spark discharging portion and said spark landing portion cooperate to form a spark in the form of a hollow column having one end thereof in the shape of the geometric figure defining the spark discharging portion and the other end in the shape of the geometric figure defining the spark landing;

b. means on said free end portion of said second electrode defining a port extending through said second electrode free end portion, said port being within and surrounded by said ridge on said second electrode free end portion; and c. means on said free end portion of said second electrode defining a reduced width and thickness portion adjacent said ridge on said second electrode free end portion.

2. In a spark plug as set forth in claim 1 including:

a. means on said free end portion of said first electrode defining a recess within and surrounded by said ridge on said first electrode free end portion, said recess in said first electrode free end portion being coaxial with said port through said second electrode free end portion;

b. means on said free end portion of said first electrode defining a port extending between said recess in said first electrode free end portion and the exterior surface of said first electrode and c. means on said first electrode free end portion defining a reduced thickness portion in said first electrode exterior surface and positioned between said port in said first electrode free end portion and an adjacent end of the insulator, said reduced thickness portion being an endless groove.

3. In a spark plug as set forth in claim 1 including:

a. means on said free end portion of said first electrode defining a recess within and surrounded by said ridge on said first electrode free end portion; and b. means on said free end portion of said first electrode defining a reduced thickness portion positioned between said ridge on said first electrode free end portion and an adjacent end of the insulator, said reduced thickness portion being an endless groove.

4. In a spark plug as set forth in claim 3 including means on said free end portion of said first electrode defining a port extending between said recess in said first electrode free end portion and the exterior surface of said first electrode.

5. In a spark plug as set forth in claim 1 wherein:

a. said first electrode includes a longitudinal axis extending between opposite ends of said first electrode;

b. said free end portion of said first electrode includes means defining a recess within and surrounded by said ridge on said first electrode free end portion, said recess having a depth of less than the transverse dimension of said first electrode free end portion; and c. said free end portion of said first electrode includes means defining a bore extending transversely through said free end portion of said first electrode and intersecting the longitudinal axis of said first electrode and intersecting and communicating with said recess in said first electrode.

6. In a spark plug as set forth in claim 1 wherein:

a. said first electrode includes a longitudinal axis extending between opposite ends of said first electrode;

b. said means defining said port through said second electrode free end portion includes a surface having one edge forming an upper limit for and a common edge with said ridge on said second electrode free end portion; and c. said means defining said ridge on said second electrode free end portion includes a surface extending from and inclined from the common edge of the surface defining said port through said second electrode and the spark landing surface whereby the common edge forming the upper limit for said ridge on said second electrode free end portion is closest to said ridge on said first electrode free end portion.

7. In a spark plug as set forth in claim 6 wherein the spark landing surface has an incline in the nature of 5° to 15° from a plane through the common edge of the surface defining said port through said second electrode and the spark landing surface and parallel with the surface defining the spark discharging surface.

8. In a spark plug as set forth in claim 1 wherein:

a. said first electrode free end portion includes a surface defining a recess within and surrounded by said ridge defining the spark discharging portion; and b. said port through said second electrode free end portion has a diameter larger than the surface defining said recess in said first electrode free end portion whereby the spark is larger at the spark landing portion than at the spark discharging portion.

* * * * *